United States Patent [19]

Doi

[11] 4,145,636

[45] Mar. 20, 1979

[54] FLUORESCENT LAMP DRIVING CIRCUIT

[75] Inventor: Shigemitsu Doi, Kawagoe, Japan

[73] Assignee: I. S. Engineering Co., Ltd., Kawagoe, Japan

[21] Appl. No.: 822,642

[22] Filed: Aug. 8, 1977

[30] Foreign Application Priority Data

Aug. 9, 1976 [JP] Japan ..... 51-105536[U]

[51] Int. Cl.[2] ..... H05B 39/00; H05B 41/14

[52] U.S. Cl. ..... 315/101; 315/105; 315/219; 315/221; 315/DIG. 5; 315/DIG. 7

[58] Field of Search ..... 315/101, 105, 107, 219, 315/221, 99, DIG. 5, DIG. 7; 331/111, 112

[56] References Cited

U.S. PATENT DOCUMENTS

| | | | |
|---|---|---|---|
| 3,066,241 | 11/1962 | Palmer | 315/107 X |
| 3,501,674 | 3/1970 | Moore | 315/105 |
| 3,505,562 | 4/1970 | Engel | 315/DIG. 7 |
| 3,720,861 | 3/1973 | Kahanic | 315/101 |
| 3,882,354 | 5/1975 | May | 315/105 |
| 4,071,807 | 1/1978 | Ichinose | 315/101 |

*Primary Examiner*—Saxfield Chatmon, Jr.
*Attorney, Agent, or Firm*—Fleit & Jacobson

[57] ABSTRACT

There is disclosed an oscillator circuit for driving a fluorescent lamp, which comprises a power transistor having an emitter electrode connected to one terminal of a D.C. power source and a collector electrode connected to the other terminal of the D.C. power source through a primary winding of a transformer. A first secondary winding of the transformer is connected at its one end to the other terminal of the D.C. power source and at its other end to a base electrode of the transistor through one of a pair of filaments of the fluorescent lamp. A second secondary winding of the transformer is connected at its one end to the one filament of the fluorescent lamp and at its other end to the other filament of the fluorescent lamp to cause discharge in the fluorescent lamp.

3 Claims, 1 Drawing Figure

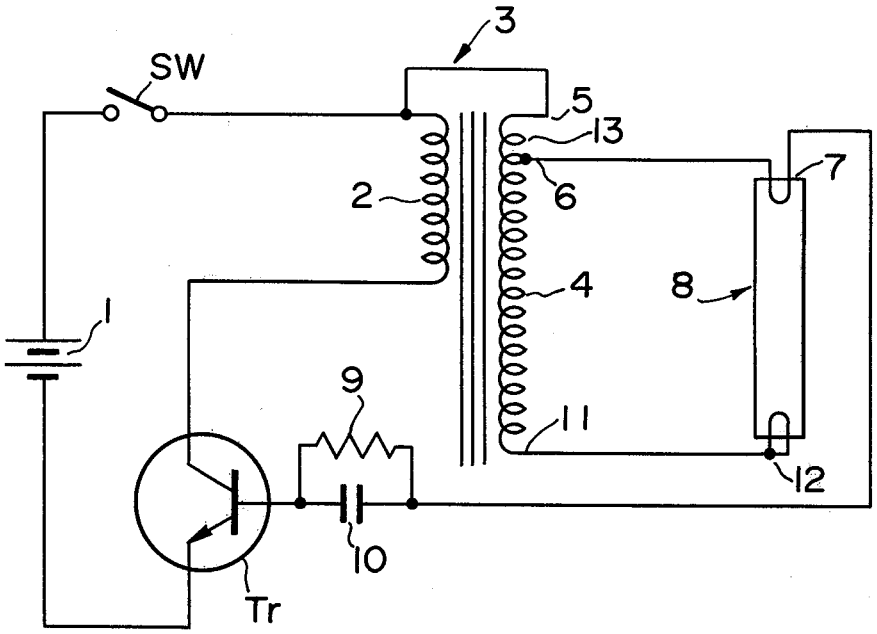
3
SW
5
13
7
2
6
4
8
1
9
11
12
10
Tr

FLUORESCENT LAMP DRIVING CIRCUIT

BACKGROUND OF THE INVENTION

1. Field of the Invention

This invention relates to a relaxation oscillator circuit for driving a fluorescent lamp with a D.C. power source such as a primary or secondary cell.

2. Description of the Prior Art

Various types of circuits for driving fluorescent lamps with a D.C. power source such as primary or secondary cells have heretofore been known. Since fluorescent lamps are ordinarily lighted by first energizing a pair of filaments thereof to pre-heat the lamp and thereafter deenergizing the filaments of the lamp to apply an A.C. voltage across the pair of filaments, the driving circuits have been ordinarily designed to convert a D.C. current from a D.C. power source into an A.C. current and generate at least a first A.C. voltage for preheating of the filaments of the lamp and a second A.C. voltage for causing discharge in the fluorescent lamp, said second voltage being greatly higher than said first voltage. Thus, typical conventional circuits for driving a fluorescent lamp with a D.C. power source have included a DC-AC convertor comprising one or two power transistors and a transformer which are connected to constitute a relaxation oscillator. The transformer has a primary winding connected to the collector of the transistor, a first secondary winding for positive feedback to the transistor, one or two second secondary windings for preheating either or both of filaments of the fluorescent lamp, and a third secondary winding for generating a high voltage applied between the pair of filaments for causing discharge in the fluorescent lamp. In the conventional circuits for driving the fluorescent lamp, therefore, the filaments of the fluorescent lamp are ceaselessly energized by the second secondary windings during lighting of the lamp, so that the amount of electric power consumed is very large. Furthermore, since the transformer has at least four or five windings, the circuit is complex and bulky. If a switch is provided for interrupting the filament preheating circuit, the driving circuit becomes even more complex and bulky.

SUMMARY OF THE INVENTION

It is, accordingly, one object of this invention to provide a novel relaxation oscillator circuit for driving a fluorescent lamp with a D.C. power source in which all the above mentioned disadvantages are eliminated.

Another object of this invention is to provide a relaxation oscillator circuit as mentioned above which is simple in construction and small in size and in which the consumption of electric power is smaller than in the conventional circuits.

The above and other objects and effects of this invention will become apparent from the detailed description of one embodiment of this invention made hereinafter with reference to the accompanying drawing.

BRIEF DESCRIPTION OF THE DRAWING

The accompanying drawing is a circuit diagram illustrating one embodiment of a relaxation oscillator circuit for driving a fluorescent lamp with a D.C. power source according to this invention.

DESCRIPTION OF THE PREFERRED EMBODIMENT

Referring to the accompanying drawing, there is shown a circuit diagram of one embodiment of a relaxation oscillator circuit for driving a fluorescent lamp with a D.C. power source, constructed in accordance with this invention. The relaxation oscillator circuit includes one NPN transistor Tr having the emitter electrode thereof connected to a negative terminal of a D.C. power source 1 such as primary or secondary battery cells. The collector electrode of the transistor Tr is connected to a positive terminal of the power source through a primary winding 2 of a transformer 3 and a manually operated switch SW. A secondary winding 4 of the transformer 3 is connected at its one end 5 to the positive terminal of the D.C. power source 1. A tap 6 of the secondary winding 4 is connected through one filament 7 of a fluorescent lamp 8 and a resistor 9 to the base electrode of the transistor Tr. A capacitor 10 is connected in parallel with the resistor 9. The other end 11 of the secondary winding 4 is connected to the other filament 12 of the fluorescent lamp 8.

Since operation of relaxation oscillators including one transistor and one transformer is well known by those skilled in the art, the operation will be explained here only in respect to those points which differ from the operation of the conventional relaxation oscillators of this type. A base bias voltage is applied to the transistor Tr through a winding portion 13 between the one end 5 and the tap 6 of the secondary winding 4, the one filament 7 of the fluorescent lamp 8 and the resistor 9. A positive feedback voltage induced across the winding portion 13 is applied through the one filament 7 and the resistor 9 to the base electrode of the transistor Tr. Therefore, the series connection of the filament 7 and the resistor serves as a bais resistor to the transistor Tr, and at the same time, the filament 7 is heated by the base current flowing through the base-emitter junction of the transistor. On the other hand, a winding portion 14 between the tap 6 and the other end 11 of the secondary winding 4 is adapted to generate an A.C. voltage sufficient to cause discharge between the filaments 7 and 12 of the fluorescent lamp 8 having the heated filament 7. Therefore, by turning the switch SW on, the relaxation oscillator initiates relaxation oscillation to light the fluorescent lamp 8 in such a manner that the one filament 7 of the fluorescent 8 is heated by the base current to the transistor Tr.

As seen from above, the winding portion 13 of the secondary winding 4 acts as a first secondary winding for positive feedback to the transistor Tr and for heating of one of the filaments of the fluorescent lamp. The winding portion 14 acts as a second secondary winding for causing discharge in the fluorescent lamp. Therefore, since the transformer is not required to have two windings one of which is for positive feedback and the other for preheating of filaments, the number of windings of the transformer is less than the number in transformers used in conventional relaxation oscillators, whereby it is possible to make the size of the transformer small. The construction of the relaxation oscillator for lighting fluorescent lamps according to this invention is very simple in comparison with the conventional relaxation oscillator for fluorescent lamps. Therefore, it will be apparent that illumination devices having a fluorescent lamp lighted by a relaxation oscillator according to this invention become much smaller in size than the conventional illumination devices.

A transistor used in ordinary relaxation oscillators has a protection base resistor for giving a proper bias voltage to the transistor and for preventing excessive current from flowing through the base of the transistor. In this embodiment, such a protection base resistor is composed of the resistor 9 and the one filament 7 of the fluorescent lamp 8. In the other words, a part of the power to be consumed by the protection base resistor is utilized to heat the one filament 7 of the fluorescent lamp 8, and therefore, the consumption of electric power is reduced compared with the conventional relaxation oscillators.

It will be apparent to a person skilled in the art that, since the capacitor 10 is provided for capacitance matching with the transistor, the capacitor may be omitted.

It will also be apparent to a person skilled in the art that the relaxation oscillator circuit for driving a fluorescent lamp according to this invention is effectively applicable to electric hand torches, electric lanterns and other illumination means for hand use, and automobiles, boats, and the like.

I claim:

1. A relaxation oscillator circuit for driving a fluorescent lamp with a D.C. power source comprising a transistor having a first electrode connected to one terminal of the D.C. power source, and a transformer having a primary winding one end of which is connected to the other terminal of the D.C. power source and the other end being connected to a second electrode of said transistor, said transformer having a first secondary winding connected at one end thereof to said other terminal of the D.C. power source and at the other end thereof to a third electrode of said transistor through a resistor and one of a pair of filaments of the fluorescent lamp, said transformer also having a second secondary winding connected across the pair of filaments of the fluorescent lamp.

2. A relaxation oscillator circuit as set forth in claim 1 wherein said transistor is a NPN power transistor wherein the emitter electrode thereof comprises said first electrode, the collector electrode thereof comprises said second electrode, and the base electrode thereof comprises said third electrode of said power transistor, and wherein said one terminal of said D.C. power source comprises a negative terminal and said other terminal of said D.C. power source comprises a positive terminal.

3. A relaxation oscillator circuit as set forth in claim 2 wherein a capacitor is connected in parallel with said resistor.

* * * * *